US006669786B2

(12) United States Patent
Sampath

(10) Patent No.: US 6,669,786 B2
(45) Date of Patent: Dec. 30, 2003

(54) SELF-HEALING NON-CHROMATE COATINGS FOR ALUMINUM AND ALUMINUM ALLOYS

(75) Inventor: Krishnaswamy Sampath, Johnstown, PA (US)

(73) Assignee: Concurrent Technologies Corporation, Johnstown, PA (US)

( * ) Notice: Subject to any disclaimer, the term of this patent is extended or adjusted under 35 U.S.C. 154(b) by 24 days.

(21) Appl. No.: 09/859,148

(22) Filed: May 16, 2001

(65) Prior Publication Data

US 2002/0033208 A1 Mar. 21, 2002

(Under 37 CFR 1.47)

Related U.S. Application Data

(63) Continuation-in-part of application No. 09/104,481, filed on Jun. 25, 1998, now Pat. No. 6,248,183.
(60) Provisional application No. 60/051,100, filed on Jun. 27, 1997.

(51) Int. Cl.[7] ..... C23C 22/00
(52) U.S. Cl. ..... 148/273; 148/247; 148/261; 148/270; 148/272; 148/275; 148/276; 148/280; 106/14.05; 106/14.11; 252/387

(58) Field of Search ..... 148/247, 261, 148/270, 272, 273, 275, 276, 280; 106/14.05, 14.11; 252/387

(56) References Cited

U.S. PATENT DOCUMENTS 4,264,378 A * 4/1981 Oppen et al. ..... 148/261
5,192,374 A * 3/1993 Kindler ..... 148/272

* cited by examiner

*Primary Examiner*—John Sheehan
*Assistant Examiner*—Andrew L. Ottmans
(74) *Attorney, Agent, or Firm*—Buchanan Ingersoll, P.C.

(57) ABSTRACT

Disclosed are processes and compositions of solutions for chromate-replacement coatings for aluminum and aluminum alloys. A preferred method includes forming a boehmite coating layer that includes Al (III) ions on an aluminum surface, and applying an ionic conversion coating solution to the coating layer. The ionic conversion coating solution comprises hexavalent and trivalent ions. The trivalent ions are selected from the group consisting of Ce, Ga, Mn, Sc, Ti, Te and V. The hexavalent ions are selected from the group consisting of Mn, Mo, Se and W. It is contended that the resulting coatings provide corrosion resistance and self-healing effect in any defects present in the coatings.

20 Claims, 1 Drawing Sheet

SELF-HEALING NON-CHROMATE COATINGS FOR ALUMINUM AND ALUMINUM ALLOYS

RELATED APPLICATIONS

This application is a continuation-in-part of application Ser. No. 09/104,481, filed Jun. 25, 1998 now U.S. Pat. No. 6,248,183, which is based on provisional application No. 60/051,100, filed Jun. 27, 1997.

BACKGROUND

The present invention relates to conversion coating compounds and processes for applying conversion coating to aluminum and aluminum alloys. In particular, the conversion coating compounds disclosed herein enable non-chromate coatings having self-healing properties.

Aluminum, and its alloys, are a common material used in a variety of applications due to their specific strength as compared to other alloys. Unfortunately, numerous aluminum alloys have high negative standard reduction potentials, lending them a tendency to oxidize and corrode. Therefore, conversion coatings are applied to aluminum surfaces to provide protection against corrosion.

Conversion coatings describe a surface film formed by a reaction in which a portion of the base metal is converted to a component of the film. As a result of this reaction and conversion, the film becomes an integral part of the metal surface, exhibiting excellent adhesive properties.

Conversion coatings are generally of two types, chemical and electrolytic. With electrolytic conversion coatings, a metal substrate is immersed in a chemical bath and an electric current is passed through the metal component and the chemical bath to form a conversion coating on the surface of the metal. A chemical conversion solution produces coatings entirely through chemical energy, without assistance from an externally applied electric potential.

When treating aluminum with a chemical conversion coating, the chemical conversion coating solution must include an active agent capable of reacting with both the aluminum substrate and an aluminum oxide surface film that forms whenever oxygen reacts with an aluminum surface. Also required is an agent capable of forming an oxide coating on the surface of the aluminum. For example, an oxidizing agent may assist in forming an oxide coating capable of forming an insoluble compound with aluminum or other ions, or an agent may promote coating formation by a controlled hydrolysis reaction.

Several types of chemical conversion coatings have been developed using such chemical compounds as alkaline oxide, crystalline phosphate, amorphous phosphate, chromate, and boehmite. However, the most widely used active agent in conversion coatings is chromate. Applied in acid solutions, chromate coatings provide effective corrosion resistance and self-healing capacity.

In preventing corrosion through chromate conversion coating of aluminum, an aluminum surface is dipped in deionized water to form a gel layer. The gel layer contains aluminum ions in the trivalent [Al (III)] state. Subsequently, chromate ions in the hexavalent [Cr (VI)] and trivalent [Cr (III)] state replace some of the Al (III) ions in the gel layer. Trivalent Cr (III) ions are believed to allow for hardening of the gel layer and hexavalent Cr (VI) ions are believed to promote self-healing by migrating to active corrosion sites. As such, trivalent Cr (III) ions and hexavalent Cr (VI) ions provide two complementary functions with the net effect of a conversion coating characterized by a hard gel and self-healing.

A self-healing capacity is a known characteristic of chromate coatings. Self-healing is in essence a dynamic repair of newly created breaks or defects in the protective film created by the chemical conversion process. The exact mechanism of self-healing is currently not well understood. While not limiting the present invention to a particular theory of operation, the mechanism for self-healing is currently understood to involve migration of hexavalent Cr (VI) ions from a reservoir in the conversion coating to a distant active exposed site to subsequently inhibit corrosion. This phenomenon is evidenced, for example, by the minimal corrosion that occurs after salt-spray testing even when the sample has a scribe mark through the coating to the metal alloy substrate.

However, solutions containing chromium ions in the hexavalent state have been determined to be carcinogenic. The U.S. Environmental Protection Agency (EPA) has included chromium to the list of toxic chemicals for 'voluntary' replacement and promulgated strict waste disposal standards to curtail the use of chromium. Strict waste disposal standards and chromium's listing as a toxic chemical have created a need for alternative chemical conversion coating compounds that do not contain the Cr (VI) ion while preserving effective corrosion inhibition and self-repair.

Some chromate-replacement coatings have been developed to avoid the problems associated with chromate coatings. For example, one method for coating aluminum surfaces uses different metals such as selenium, tellurium, titanium, boron, calcium, cobalt, copper, iron, magnesium, nickel, tin, or zirconium. The method includes forming a hydrated oxide film on the aluminum surface ($AlOOH.nH_2O$) and treating the oxide film with alcoholates of any of these metals. However, the method suffers from serious problems. It is contended that the use of the method results in a coating inferior to chromium conversion coatings because such coating lacks the complementary functions of hexavalent and trivalent ions. The complementary functions provide for hardness of the aluminum gel and self-healing properties. Additionally, the coatings produced by this method are not designed to provide for dynamic repair of newly created corrosion sites or breaks in the conversion coating layer.

Another method currently available for providing chromium-free coating for aluminum includes immersing the aluminum surface in boiling deionized water to form a gel layer, boehmite, on the aluminum surface. The coating layer is then exposed to an aqueous solution of cerium salts to form cerium oxides within the gel layer. However, the resulting cerium coating suffers from various problems. Cerium ions in the trivalent [Ce (III)] state are not known to migrate to active corrosion sites or breaks, unlike Cr (VI) ions. Because Ce (III) ions are incapable of mimicking Cr (VI) ions, Ce (III) ions are unlikely to provide self-healing in any defects in the coating layer. Cerium coating thus provides less corrosion protection than chromate coatings.

Consequently, in light of the problems associated with presently available aluminum chromate-replacement coatings, there exists an unfulfilled need for aluminum non-chromate coatings that mimic chromate coating interactions with outside environment. In particular, there is a need for non-chromate coatings that provide hardness for the coating and dynamic repair at newly created active corrosion sites, breaks or defects in the coating layer. The invention reported herein fulfills this need.

SUMMARY

An object of the present invention is to provide for non-carcinogenic conversion coatings to replace current carcinogenic chromate coatings.

Another object of the present invention is to provide for non-chromate coatings that mimic chromate conversion coating characteristics.

Another object of the present invention is to provide for a non-chromate coating that provides a combination of self-healing and durable coating features.

Yet another object of the present invention is to provide for a hard, wear-resistant, corrosion-resistant, and paint adherent surface coating to replace current chromate coatings for aluminum and aluminum alloys.

A related object of the present invention is to provide processes for applying chromate-replacement coatings to aluminum and aluminum surfaces.

A further object of the present invention is to provide for non-chromate conversion coatings that use a wide variety of substrate metals.

Another object of the present invention is to provide for ionic coating solutions enabling specific ions to replace aluminum ions in the gel layer on the aluminum surface.

A related object of the present invention is to provide for an ionic coating solution comprising a combination of at least two different ions, with the exception of solutions comprising only manganate ions.

Yet another object of the present invention is to provide for non-chromate conversion coatings comprising hexavalent and trivalent ions.

A more specific object of the present invention is to enable a non-chromate ionic coating for aluminum having ions that migrate to newly created corrosion sites or breaks in the coating layer.

The above-listed objects are met or exceeded by the present invention. The present invention enables the production and use of chromate-replacement coatings on aluminum and aluminum alloys to provide corrosion resistance and dynamic active repair of any newly created corrosion sites. The present invention provides for both trivalent and hexavalent metallic ions to replace aluminum ions in a gel layer on an aluminum surface. It is contended that such substitution of aluminum ions in the gel by hexavalent and trivalent ions from metallic solutions enables such metallic coatings to act like chromate coatings.

A preferred process for coating an aluminum surface includes cleaning the aluminum surface for removing contaminants, and then immersing the aluminum surface in deionized water. A gel layer forms on the aluminum surface by the reaction of aluminum with water. The gel layer is initially amorphous and contains trivalent Al (III) ions. Thereafter, the aluminum surface is treated with any one of the disclosed chromate-replacement conversion coatings.

Prior art solutions suggested the use of covalent bonding coating solutions. The present invention suggests the use of ionic coating solutions. Prior art solutions suggested the use of a single metal for coating aluminum. The present invention provides for the use of at least two metals, with the exception of manganese, which can be used exclusively. Prior art solutions suggested coating aluminum by first forming a porous gel layer, which contains aluminum ions, on the aluminum surface and plugging the pores of the layer with different metals. The present invention suggests forming a gel layer. Prior art solutions suggested using certain metallic compounds that react with the aluminum ions in the gel layer. The present invention suggests partially replacing the aluminum ions in the gel layer. Prior art solutions suggested the use of metallic ions having several oxidation states. The present invention suggests the use of metallic ions having (III) and (VI) oxidation states. Prior art solutions suggested the use of metallic coatings for aluminum surfaces that were not designed to provide for self-healing. The present invention discloses non-chromate coatings for aluminum that provide for self-healing.

BRIEF DESCRIPTION OF THE DRAWING

The above and other features, aspects, and advantages of the present invention are considered in more detail, in relation to the following description of embodiments thereof shown in the accompanying drawing, in which.

DETAILED DESCRIPTION

Figure 1:
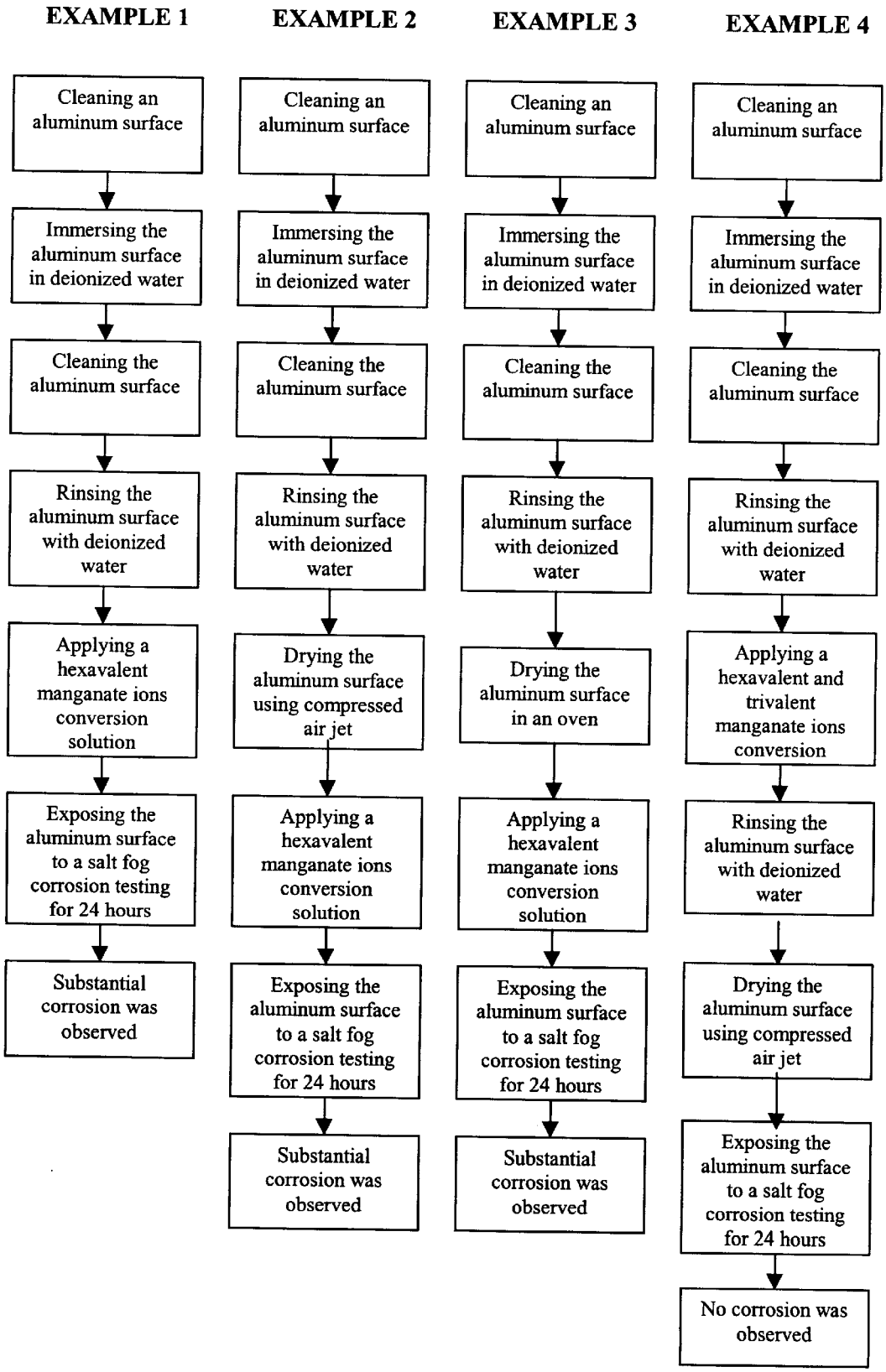
FIG. 1 is a flow diagram presenting common stages in a conversion coating process according to the present invention.

The invention summarized above and defined by the enumerated claims may be better understood by referring to the following description. This detailed description of an embodiment, set out below to enable those skilled in the art to build and use an implementation of the invention, is not intended to limit the enumerated claims, but to serve as a particular example thereof. Those skilled in the art should appreciate that they may readily use the concepts and specific embodiment disclosed as a basis for modifying or designing other methods and systems for carrying out the same purpose of the present invention. Those skilled in the art should also realize that such equivalent assemblies do not depart from the spirit and scope of the invention in its broadest form.

The present invention provides for improved chromate-replacement coatings for aluminum and aluminum alloys and an improved process for applying them. In particular, such coatings are produced from conversion coating solutions. Such solutions are metallic ionic solutions applied to aluminum and aluminum alloys surfaces to yield a coating equivalent or superior to that of a chromate coating.

The first step in coating aluminum surfaces is to form a thin gel coating layer over such aluminum surface. When the aluminum surface is treated with deionized water at 50–100 degree centigrade, a porous boehmite layer forms over the aluminum surface. The resulting porous gel-like layer of boehmite is comprised of hydrated aluminum hydroxy oxide ($AlOOH.nH_2O$). Such a step is described in U.S. Pat. Nos. 4,988,396; and 5,192,374, all of which are incorporated by reference.

The chemical conversion coating solution of the present invention comprises metallic ions having both trivalent [M (III)] and hexavalent [M (VI)] states to substitute Al (III) ions in the gel-like layer. It is contemplated that the coating solution may also be mixed with wetting agents such as sulfonates that enable uniform and continuous coating. It is also contemplated that the coating solution may include additives such as acetates and nitrates that activate the aluminum surface and control the rate of reaction.

While not limiting the present invention to a particular theory of operation, it is believed that trivalent Cr (III) ions in chromate conversion coatings substitute trivalent Al (III) ions due to similarity in valency and size of the chromium and aluminum ions. Additionally, the secondary hexavalence of chromium Cr (VI) ions may contribute to partial substitution of Al (III) ions. As such, coating solutions having metallic ions in both the trivalent and hexavalent states will interact with aluminum like chromium ions. Thus, the promotion of hardening of the gel upon drying as well as enhanced mechanical strength is believed to occur from M (III) substitution of Al (III) ions in the gel. It is contended that the substitution of M (VI) ions for a portion of the Al (III) ions in the gel is responsible for providing the resulting coating with significant corrosion resistance and the ability to self-heal.

One of the factors that determine when replacement or substitution can occur is the size of a metallic ion relative to aluminum (III) ion. Substitutions can occur when there is a minimal difference in the size of metallic ions relative to aluminum ions. The Hume-Rothery rule allows for the substitution of ions (or atoms) when the ionic (atomic) radii do not differ by more than 15% and when the coordination numbers of the respective ions are the same. Table I illustrates coordination numbers and radii of some metallic ions in either a trivalent (III) or hexavalent (VI) state that exhibit an ionic radius comparable to that of Al (III). Table I is illustrative and not exhaustive.

TABLE I

| No. | Metallic Cation (Valence State) | Coordination Number(s) | Ionic Radius (Å) |
|---|---|---|---|
| 1 | Al (III) | 4, 6 | 0.39, 0.54 |
| 2 | Cr (III) | 6 | 0.62 |
| 3 | Cr (VI) | 4 | 0.26 |
| 4 | Ce (III) | 6, 8, 12 | 1.01, 1.14, 1.29 |
| 5 | Ga (III) | 4, 6 | 0.47, 0.62 |
| 6 | Mn (III) | 6 | 0.58 |
| 7 | Mn (VI) | 4 | 0.26 |
| 8 | Mo (VI) | 6, 7 | 0.59, 0.73 |
| 9 | Sc (III) | 6, 8, 12 | 0.745, 0.87, 1.116 |
| 10 | Se (VI) | 4, 6 | 0.50, 0.42 |
| 11 | Ti (III) | 6 | 0.67 |
| 12 | Te (III) | 6 | 0.56 |
| 13 | V (III) | 6 | 0.64 |
| 14 | W (VI) | 4, 6 | 0.42, 0.60 |

Note: When an ion exhibits two ore more coordination numbers, the ionic radius increases with increasing coordination number, except for Selenium.

Table I predicts that some elements will replace aluminum ions easier than others provided that all other factors are the same. Manganese (III) ion with coordination number of 6, for example, has an ionic radius of 0.58, which is within Hume-Rothery's 15% difference. Titanium (III) with a coordination number of 6 has an ionic radius of 0.67, which is larger than such 15% difference. It is contended that manganese (III) ions will replace aluminum ions in gel layers more easily than titanium ions will replace aluminum ions, provided that every thing else is same. In such case, manganese (III) ions are preferred over titanium ions. Other factors such as thermodynamics of each substitution reaction, kinetics, pressure, temperature, concentration of reactants will also affect the feasibility of ion replacement.

The present invention may be further understood from the tests that were performed as described in the examples below. In each case, prior to the test, an aluminum substrate was prepared following common process steps illustrated in FIG. 1, as follows:

1. Immersion of an aluminum substrate in Turco 4215 Cleaner™ (52.2 g/l) for 30 minutes followed by a deionized (DI) water rinse. (Turco 4215 Cleaner™ is a tradename for a cleaner manufactured and sold by Turco Products Division of Purex Corporation, Wilmington, Calif.).
2. The aluminum substrate is then immersed in Turco Smut-Go™ (179 g/l) for 10 minutes followed by a DI water rinse. (Turco Smut-Go™ is a tradename for a cleaner manufactured and sold by Turco Products Division of Purex Corporation, Wilmington, Calif.).

The following examples are presented to illustrate superior aspects of the present invention to assist one of ordinary skill in the art in making and using it, and is not intended in any way to otherwise limit the scope of this disclosure or the protection granted by the Letters Patent hereon. These examples are illustrated in FIG. 1.

EXAMPLE 1

Panels of 2024 aluminum alloy having dimensions of 7.5 cm by 10 cm were immersed in a potassium manganate bath to form a conversion coating. After standard practices of steps one and two, some panels were immersed in boiling deionized (DI) water for 5 minutes. Following the boiling DI water bath, the panels were immersed in various concentrations of potassium manganate for different lengths of time followed by a DI water rinse. Altogether 16 coatings were produced on 2024 aluminum alloy panels. Subsequently, additional coatings were produced on two sets of 6061 and 5052 aluminum alloy test panels having approximately the dimensions of 6.5 cm by 7.5 cm each. Following a completed conversion treatment the panels were exposed to ASTM B 117 salt fog corrosion testing for 24 hours. Table II provides a listing of experimental conditions and the corrosion testing results.

TABLE II

| Expt. Number | Coupon Number | Boiling Water Used | Manganate Concentration* | Time in Manganate Bath | Final Dip in 50% HF | Salt Spray Results (No. of Pits) | Corrosion Rating Index** |
|---|---|---|---|---|---|---|---|
| 01 | 01-02 | yes | Low | 1 minute | yes | TNTC | 0/0 |
| 01 | 03-04 | yes | Low | 1 minute | no | 377/325 | 0/1 |
| 01 | 05-06 | no | Low | 1 minute | yes | TNTC | 0/0 |
| 01 | 07-08 | no | Low | 1 minute | no | 400/480 | 0/0 |
| 02 | 01-02 | yes | Low | 5 minutes | yes | TNTC | 0/0 |
| 02 | 03-04 | yes | Low | 5 minutes | no | TNTC | 0/0 |
| 02 | 05-06 | no | Low | 5 minutes | yes | TNTC | 0/0 |
| 02 | 07-08 | no | Low | 5 minutes | no | TNTC | 0/0 |
| 03 | 01-02 | yes | High | 1 minute | yes | TNTC | 0/0 |
| 03 | 03-04 | yes | High | 1 minute | no | 395/397 | 0/0 |
| 03 | 05-06 | no | High | 1 minute | yes | TNTC | 0/0 |
| 03 | 07-08 | no | High | 1 minute | no | 335/323 | 0/0 |
| 04 | 01-02 | yes | High | 5 minutes | yes | TNTC | 0/0 |
| 04 | 03-04 | yes | High | 5 minutes | no | 187/145 | 1/1 |
| 04 | 05-06 | no | High | 5 minutes | yes | TNTC | 0/0 |
| 04 | 07-08 | no | High | 5 minutes | no | 229/168 | 0/1 |

TABLE II-continued

| Expt. Number | Coupon Number | Boiling Water Used | Manganate Concentration* | Time in Manganate Bath | Final Dip in 50% HF | Salt Spray Results (No. of Pits) | Corrosion Rating Index** |
|---|---|---|---|---|---|---|---|
| 05 | 5052 Alloy | yes | Low | 1 minute | no | 228 | 2 |
| 05 | 5052 Alloy | yes | Low | 1 minute | no | 240 | 2 |
| 06 | 6061 Alloy | yes | Low | 1 minute | no | 301 | 1 |
| 06 | 6061 Alloy | yes | Low | 1 minute | no | 311 | 1 |

TNTC = too numerous to count.
*Composition of the manganate bath: "low" concentration = potassium manganate - 10 g/l; potassium hydroxide - 50 g/l; potassium phosphate dibasic - 17.5 g/l; and potassium fluoride - 17.5 g/l. "High" concentration = potassium manganate - 40 g/l; potassium hydroxide - 200 g/l; potassium phosphate dibasic - 70 g/l; and potassium fluoride - 70 g/l.
*Corrosion rating index based on ASTM D 1654; 0 = over 75% of surface corroded, while 10 = no corrosion observed. The conversion coatings were formed without the addition of Al $(OH)_3$ to the bath.

EXAMPLE 2

Standard practice steps one and two were performed on eight panels of 6061 aluminum alloy having the approximate dimensions of 6.5 cm by 7.5 cm. Subsequently, six out of eight panels of 6061 aluminum alloy were immersed in a DI boiling water bath. The test panels were either placed in the manganate bath directly from the boiling water bath, or air dried with a compressed air jet prior to immersion in the manganate bath. Only the low concentration potassium manganate bath (potassium manganate 10 g/l; potassium hydroxide 50 g/l; potassium phosphate dibasic 17.5 g/l; and potassium fluoride 17.5 g/l) was used because it was found to form coatings with the best corrosion resistance. Additionally, aluminum hydroxide dry gel [$Al(OH)_3$] was added at 10 g/l to the manganate solution. Following the completed conversion treatment the panels were exposed to ASTM B 117 salt fog corrosion testing for 24 hours. Table III provides a listing of the experimental conditions used and the corrosion testing results.

TABLE III

| Coupon Numbers | Manganate Bath Formulation | Boiling Water Used | Air Drying Used | Time in Manganate Bath | Salt Spray Results No. of Pits | Corrosion Rating Index |
|---|---|---|---|---|---|---|
| N1 | 10 g/l, no $Al(OH)_3$ | No | No | 60 seconds | 341 | 3 |
| N2 | 10 g/l, no $Al(OH)_3$ | Yes | No | 60 seconds | 308 | 3 |
| N3 | 10 g/l, no $Al(OH)_3$ | Yes | Yes | 60 seconds | 269 | 3 |
| N4 | 10 g/l, no $Al(OH)_3$ | Yes | Yes | 30 Seconds | 283 | 3 |
| A1 | 10 g/l, with $Al(OH)_3$ | No | Yes | 60 seconds | 212 | 4 |
| A2 | 10 g/l, with $Al(OH)_3$ | Yes | No | 60 seconds | 187 | 4 |
| A3 | 10 g/l, with $Al(OH)_3$ | Yes | Yes | 60 seconds | 238 | 3 |
| A4 | 10 g/l, with $Al(OH)_3$ | Yes | Yes | 30 Seconds | 161 | 4 |

*Corrosion rating index based on ASTM D 1654; 0 = over 75% of surface corroded, while 10 = no corrosion observed.

EXAMPLE 3

Standard practice steps one and two were performed on seven panels of 2024 aluminum alloy having the approximate dimensions of 7.5 cm by 10 cm. Subsequently six out of seven panels of 2024 aluminum alloy were immersed in a DI boiling water bath. The test panels were either placed in the manganate bath after being dried in an oven for three minutes or air dried with a compressed air jet prior to immersion in the manganate bath. Only the low concentration potassium manganate bath (potassium manganate 10 g/l; potassium hydroxide 50 g/l; potassium phosphate dibasic 17.5 g/l; and potassium fluoride 17.5 g/l) was used because it was found to provide the coatings with the best corrosion resistance. Additionally, certain tests added aluminum hydroxide dry gel [Al $(OH)_3$] at 15 g/l to the manganate bath solution. Following the completed conversion treatment the panels were exposed to ASTM B 117 salt fog corrosion testing for 24 hours. Table IV provides a listing of the experimental conditions used and the corrosion testing results.

TABLE IV

| Coupon Numbers | Manganate Bath | Boiling Water Used | Air or Oven Drying | Time in Manganate Bath | Salt Spray Results No. of Pits | Corrosion Rating Index* |
|---|---|---|---|---|---|---|
| 96-1950 | 10 g/l, with $Al(OH)_3$ | no | Air | 60 seconds | 396 | 3 |
| 96-1951 | 10 g/l, with $Al(OH)_3$ | no | Oven | 60 seconds | 495 | 2 |
| 96-1952 | 10 g/l, with $Al(OH)_3$ | no | Oven | 30 seconds | 515 | 2 |
| 96-1953 | 10 g/l, no $Al(OH)_3$ | no | Air | 60 seconds | TNTC | 0 |
| 96-1954 | 10 g/l, no $Al(OH)_3$ | no | Oven | 60 seconds | 460 | 2 |
| 96-1955 | 10 g/l, no $Al(OH)_3$ | no | Oven | 30 seconds | 450 | 2 |
| 96-1956 | No manganate used | yes | Oven | Control | TNTC | 0 |

TNTC = too numerous to count
*Corrosion rating index based on ASTM D 1654; 0 = over 75% of surface corroded, while 10 = no corrosion observed.

EXAMPLE 4

Panels of 6061 aluminum alloy having dimensions 7.5 cm×10 cm were immersed in a solution containing 5 g of floutitanic acid and 5 g of alconox (alkyl aryl sulfonate) in 500 ml of DI water at ambient temperature for about 5 minutes to allow conditioning and activity, followed by a DI water rinse. The panels were subsequently immersed for about 10 minutes in a solution containing 5 g of potassium manganate, 2 g of potassium fluoride, 2 g of potassium hydroxide, 4 g of sodium hydrosulfite ($Na_2S_2O_4$) and 40 ml of orthophosphoric ($H_3PO_4$) acid in 100 ml of DI water with the resulting solution having a measured pH of about 3.4. The panels were rinsed in DI water, allowed to air-dry and subsequently dried for 24 hours in an oven held at 100° F. The panels were then subjected to salt fog corrosion testing per ASTM B117 for 24 hours. Table V provides a listing of the experimental conditions used and the corrosion testing results.

TABLE V

| Coupon Numbers | Boiling Water Used | Time in Manganate Bath | DI Water | Oven Drying | Salt Spray Results No. of Pits | Corrosion Rating Index* |
|---|---|---|---|---|---|---|
| 98-0043-P | No | 10 Minutes | Final Rinse | Yes | None | 8 |
| 98-0044-P | No | 10 Minutes | Final Rinse | Yes | None | 10 |

*Corrosion rating index based on ASTM D 1654; 8 = over 0.01% corroded, whole 10 = no corrosion observed In the preceding examples, several compounds were utilized in addition to the metallic ions. The compounds included a uniform coating agent such as potassium fluoride, a base source to facilitate formation of the boehmite gel layer, such as potassium hydroxide, and an acid source to control acidic pH level, such as orhophosphoric acid. In example 1, aluminum panels were exposed to boiling deionized water to form a boehmite coating layer on surfaces of such panel. The panels were then treated in a conversion coating bath. The bath mainly included manganate ions having (VI) oxidation state. No metallic (III) ions were included. In example 2, aluminum panels were subjected to the same process as in example 1 with the exception of a lower concentration of potassium manganate. In example 3, steps similar to examples 1 and 2 were repeated to aluminum panels with the addition of aluminum hydroxide. In examples 1–3, the resulting coating did not provide adequate corrosion resistance.

However, in example 4, potassium manganate was used along with a reduction agent, such as a sodium hydrosulfite. As a result, some of the manganese ions were reduced from (VI) to (III) state. Both (III) and (VI) ions were present in such conversion coating bath. The resulting coating from example 4 exhibited superior corrosion resistance. No corrosion was observed after subjecting the aluminum panels to a 24 hour salt fog corrosion test. Characteristics of improved mechanical strength and self-healing ability were demonstrated.

Other embodiments of the present invention may enable, but are not limited to, the following compositions of conversion coating solutions comprising:

potassium dioxomanganate ($KMnO_2$), potassium manganate ($K_2MnO_4$), potassium fluoride (KF), potassium hydroxide (KOH), and orthophosphoric acid ($H_3PO_4$)

cerium salt, $K_2MnO_4$, KF, KOH, and $H_3PO_4$ gallium salt, $K_2MnO_4$, KF, KOH, and $H_3PO_4$ scandium salt, $K_2MnO_4$, KF, KOH, and $H_3PO_4$ tellurium salt, $K_2MnO_4$, KF, KOH, and $H_3PO_4$ titanium salt, $K_2MnO_4$, KF, KOH, and $H_3PO_4$ vanadium salt, $K_2MnO_4$, KF, KOH, and $H_3PO_4$ molybdenum salt, $KMnO_2$, KF, KOH, and $H_3PO_4$ molybdenum salt, cerium salt, KF, KOH, and $H_3PO_4$ molybdenum salt, gallium salt, KF, KOH, and $H_3PO_4$ molybdenum salt, scandium, KF, KOH, and $H_3PO_4$ molybdenum salt, tellurium salt, KF, KOH, and $H_3PO_4$ molybdenum salt, titanium salt, KF, KOH, and $H_3PO_4$ scandium salt, $KMnO_2$, KF, KOH, and $H_3PO_4$ selenium salt, cerium salt, KF, KOH, and $H_3PO_4$ selenium salt, gallium salt, KF, KOH, and $H_3PO_4$ Such embodiments preferably first immerse panels of aluminum alloy in a solution containing deionized water. The panels are then preferably immersed for about 10 minutes in a solution comprising the compositions as listed above or the like. It is contemplated that the panels may be rinsed in DI water, allowed to air-dry. The panels may be subjected to further drying in an oven.

Although the present invention has been described in considerable detail with reference to certain preferred compositions and methods thereof, others are possible. Therefore, the spirit and scope of the appended claims should not be limited to the description of the preferred embodiments or versions contained herein.

I claim:

1. A non-chromate coating process for coating an aluminum surface comprising the steps of:

(a) forming a coating layer on said aluminum surface, wherein said coating layer comprises trivalent aluminum ions; and (b) applying a solution to said coating layer, said solution comprising a first metal ion having a trivalent state and a second metal ion having a hexavalent state, whereby said first and second metal ions partially replace said trivalent aluminum ions to form a coating having a self-healing effect;

wherein said first and said second metal ions have the same coordination number as said trivalent aluminum ions, and further wherein said first and said second metal ions have ionic radii sufficiently similar in size to the ionic radius of said trivalent aluminum ions such as to allow said partial replacement of said trivalent aluminum ions with said first and said second metal ions.

2. A non-chromate coating process for coating an aluminum surface comprising the steps of:

(a) forming a coating layer on said aluminum surface, wherein said coating layer comprises trivalent aluminum ions; and (b) applying a solution to said coating layer, said solution comprising a first metal ion having a trivalent state; and a second metal ion having a hexavalent state, whereby said first and second metal ions partially replace said trivalent aluminum ions to form a coating having self-healing effect;

wherein said first trivalent metal ion is selected from the group consisting of Ce, Ga, Mn, Sc, Ti, Te and V.

3. A non-chromate coating process for coating an aluminum surface comprising the steps of:

(a) forming a coating layer on said aluminum surface, wherein said coating layer comprises trivalent aluminum ions; and (b) applying a solution to said coating layer, said solution comprising a first metal ion having a trivalent state and a second metal ion having a hexavalent state, whereby said first and second metal ions partially replace said trivalent aluminum ions to form a coating having a self-healing effect;

wherein said second hexavalent metal ion is selected from the group consisting of Mn, Se and W, the process according to claim 1 wherein the first trivalent metal ion and the second hexavalent metal ion are respectively trivalent Mn and hexavalent Mn.

4. A non-chromate coating process for coating an aluminum surface comprising the steps of:

(a) forming a coating layer on said aluminum surface, wherein said coating layer comprises trivalent aluminum ions; and (b) applying a solution to said coating layer, said solution comprising a first metal ion having a trivalent state and a second metal ion having a hexavalent state, whereby said first and second metal ions partially replace said trivalent aluminum ions to form a coating having a self-healing effect;

wherein said first trivalent metal ion and said second hexavalent metal ion are respectively trivalent Mn and hexavalent Mn.

5. A non-chromate coating process for coating an aluminum surface comprising the steps of:

(a) cleaning said aluminum surface to remove contaminants;

(b) de-smutting said aluminum surface to remove surface oxides;

(c) forming a coating layer on said aluminum surface, said coating layer containing trivalent aluminum ions;

(d) drying said aluminum surface; and (e) applying a conversion coating solution to said aluminum surface, said solution containing trivalent and hexavalent metallic ions having ionic radii which do not differ from the ionic radius of said trivalent aluminum ions by more than approximately fifteen percent.

6. A non-chromate coating process for coating an aluminum surface, the process comprising the steps of:

(a) cleaning said aluminum surface to remove contaminants;

(b) de-smutting said aluminum surface to remove surface oxides;

(c) forming a coating layer on said aluminum surface, said coating layer including trivalent aluminum ions;

(d) drying said aluminum surface; and (e) applying a conversion coating solution to said aluminum surface, wherein said conversion coating solution comprises a first metal ion having a trivalent state and a second metal ion having a hexavalent state, whereby said first and said second metal ions partially replace said trivalent aluminum ions to form a self-healing coating.

7. The non-chromate coating process of claim 6 wherein said first metal ion is selected from the group consisting of Ce, Ga, Mn, Sc, Ti, Te and V and said second metal ion is selected from the group consisting of Mn, Se and W.

8. A non-chromate coating process for coating an aluminum surface having a layer of boehmite formed thereon, comprising the steps of:

(a) forming a coating layer on said aluminum surface, wherein said coating layer comprising trivalent aluminum ions; and (b) applying a solution to said coating layer, said solution comprising hexavalent metal ions which undergo partial in-situ reduction to trivalent metal ions;

wherein said trivalent and said hexavalent metal ions partially replace trivalent aluminum ions in said boehmite layer.

9. A non-chromate conversion coating applied to an aluminum surface having a layer of boehmite formed thereon, said conversion coating comprising trivalent metal ions and hexavalent metal ions, said trivalent metal ions and said hexavalent metal ions being selected from the group consisting of Ce, Ga, Mn, Sc, Se, Ti, Te, V and W, wherein said trivalent and said hexavalent ions have partially replaced trivalent aluminum ions in said boehmite layer to form a hardened coating having self-healing properties.

10. A non-chromate conversion coating applied to an aluminum surface having a layer of boehmite formed thereon, said conversion coating comprising trivalent metal ions selected from the group consisting of Ce, Ga, Mn, Sc, Ti, Te, and V, wherein said trivalent ions have partially replaced trivalent aluminum ions in said boehmite layer to form a hardened coating.

11. A non-chromate conversion coating applied to an aluminum surface, having a layer of boehmite formed thereon, said conversion coating comprising hexavalent metal ions selected from the group consisting of Mn, Se and W, wherein said hexavalent ions have partially replaced trivalent aluminum ions in said boehmite layer to form a coating having self-healing properties.

12. A non-chromate conversion coating solution for an aluminum surface comprising trivalent Mn ions and hexavalent Mn ions, wherein said trivalent and hexavalent Mn ions partially replace trivalent aluminum ions in a boehmite layer formed on said aluminum surface.

13. A non-chromate conversion coating solution for an aluminum surface comprising:

(a) trivalent metal ions;

(b) hexavalent metal ions;

(c) potassium hydroxide;

(d) sodium hydrosulfite;

(e) potassium fluoride;

(f) orthophosphoric acid; and (g) aluminum hydroxide gel;

wherein said trivalent and hexavalent metal ions partially replace trivalent aluminum ions in a boehmite layer formed on said aluminum surface.

14. A non-chromate conversion coating solution for an aluminum surface comprising:

(a) trivalent metal ions;

(b) hexavalent metal ions;

(c) about 2 grams per liter of potassium fluoride;

(d) about 2 grams per liter of potassium hydroxide;

(e) about 4 grams per liter of sodium hydrosulfite; and (f) about 40 ml per liter of orthophosphoric acid;

wherein said trivalent and hexavalent metal ions partially replace trivalent aluminum ions in a boehmite layer formed on said aluminum surface.

15. A non-chromate conversion coating solution for an aluminum surface comprising:

(a) an effective amount of trivalent metal ions;

(b) an effective amount of hexavalent metal ions;

(c) an effective amount of potassium fluoride;

(d) an effective amount of potassium hydroxide;

(e) an effective amount of sodium hydrosulfite; and (f) an effective amount of orthophosphoric acid;

wherein said trivalent and hexavalent metal ions partially replace trivalent aluminum ions in a boehmite layer formed on said aluminum surface, and further wherein said effective amount of orthophosphoric acid facilitates the substitution of said trivalent aluminum ions in said boehmite layer with said trivalent and said hexavalent metal ions.

16. A non-chromate conversion coating solution for an aluminum surface comprising:

(a) trivalent metal ions;

(b) hexavalent metal ions;

(c) about 2 grams per liter of at least one uniform coating agent;

(d) about 2 grams per liter of at least one base;

(e) about 4 grams per liter of at least one reduction agent; and (e) about 40 ml per liter of at least one acid;

wherein said trivalent and hexavalent metal ions partially replace trivalent aluminum ions in a boehmite layer formed on said aluminum surface.

17. The non-chromate coating process of claim 5 wherein said trivalent and hexavalent metallic ions have the same coordination number as said trivalent aluminum ions.

18. The non-chromate coating process of claim 8 further comprising the step of adding a reducing agent to said solution to aid in the reduction of said metal ions from a hexavalent state to a trivalent state.

19. A non-chromate coating process for coating an aluminum surface, the process comprising the steps of:

(a) forming a coating layer on said aluminum surface, wherein the coating layer comprises trivalent aluminum ions; and (b) applying a solution to the coating layer, said solution comprising a first metal ion having a trivalent state and a second metal ion having a hexavalent state, whereby said first and second metal ions partially replace said trivalent aluminum ions to form a coating having a self-healing effect;

wherein said first metal ion has the same coordination number as said trivalent aluminum ions.

20. A non-chromate coating process for coating an aluminum surface, the process comprising the steps of:

(a) forming a coating layer on said aluminum surface, wherein the coating layer comprises trivalent aluminum ions; and (b) applying a solution to the coating layer, said solution comprising a first metal ion having a trivalent state and a second metal ion having a hexavalent state, whereby said first and second metal ions partially replace said trivalent aluminum ions to form a coating having a self-healing effect;

wherein said second metal ion has the same coordination number as said trivalent aluminum ions.

* * * * *

UNITED STATES PATENT AND TRADEMARK OFFICE

CERTIFICATE OF CORRECTION

PATENT NO. : 6,669,786 B2
DATED : December 30, 2003
INVENTOR(S) : Krishnaswamy Sampath It is certified that error appears in the above-identified patent and that said Letters Patent is hereby corrected as shown below:

Column 11,
Lines 4-7, after "W", delete "the process according to claim 1 wherein the first trivalent metal ion and the second hexavalent metal ion are respectively trivalent Mn and hexavalent Mn."

Signed and Sealed this

Thirteenth Day of April, 2004

JON W. DUDAS
*Acting Director of the United States Patent and Trademark Office*